US010920777B2

(12) United States Patent
Deprez et al.

(10) Patent No.: US 10,920,777 B2
(45) Date of Patent: Feb. 16, 2021

(54) METHOD FOR REGULATING THE LIQUID INJECTION OF A COMPRESSOR OR EXPANDER DEVICE, A LIQUID-INJECTED COMPRESSOR OR EXPANDER DEVICE, AND A LIQUID-INJECTED COMPRESSOR OR EXPANDER ELEMENT

(71) Applicant: ATLAS COPCO AIRPOWER, NAAMLOZE VENNOOTSCHAP, Wilrijk (BE)

(72) Inventors: Sofie Deprez, Wilrijk (BE); Christian Schmitz, Wilrijk (BE); Johan Julia J. Dom, Wilrijk (BE); Aleksandr Pulnikov, Wilrijk (BE); Benjamin Moens, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 276 days.

(21) Appl. No.: 15/778,687

(22) PCT Filed: Sep. 12, 2016

(86) PCT No.: PCT/BE2016/000045
§ 371 (c)(1),
(2) Date: May 24, 2018

(87) PCT Pub. No.: WO2017/096439
PCT Pub. Date: Jun. 15, 2017

(65) Prior Publication Data

US 2018/0347567 A1 Dec. 6, 2018

Related U.S. Application Data

(60) Provisional application No. 62/308,952, filed on Mar. 16, 2016, provisional application No. 62/266,092, filed on Dec. 11, 2015.

(30) Foreign Application Priority Data

Mar. 1, 2016 (BE) ..... 2016/5147
Jul. 19, 2016 (BE) ..... 2016/5600

(51) Int. Cl.
*F25B 41/06* (2006.01)
*F25B 31/00* (2006.01)
(Continued)

(52) U.S. Cl.
CPC ..... *F04C 29/0014* (2013.01); *F04C 29/021* (2013.01); *F04C 29/042* (2013.01);
(Continued)

(58) Field of Classification Search
CPC .. F04C 29/0014; F04C 29/021; F04C 29/042; F04C 18/16; F04C 29/0007;
(Continued)

(56) References Cited

U.S. PATENT DOCUMENTS 1,895,092 A * 1/1933 Williams ..... F04C 29/021 184/6.16
4,394,113 A * 7/1983 Bammert ..... F04C 29/02 418/201.2
(Continued)

FOREIGN PATENT DOCUMENTS

DE 102012102346 A1 9/2013
EP 0000131 A1 1/1979
(Continued)

OTHER PUBLICATIONS

International Search Report dated Feb. 3, 2017 on PCT/BE2016/000045.

*Primary Examiner* — Deming Wan
(74) *Attorney, Agent, or Firm* — Bacon & Thomas, PLLC

(57) ABSTRACT

A Method for controlling the liquid injection of a compressor device or expander device. This compressor device
(Continued)

includes at least one compressor element or expander element, whereby the element comprises a housing that comprises a rotor chamber in which at least one rotor is rotatably affixed by means of bearings, whereby liquid is injected into the element. The method comprises the step of providing two independent separated liquid supplies to the element, whereby one liquid supply is injected into the rotor chamber and the other liquid supply is injected at the location of the bearings. The separated liquid supplies are realised by means of a modular channelling piece of an injection module.

20 Claims, 5 Drawing Sheets

(51) Int. Cl.

| | |
|---|---|
| ***F04C 29/00*** | (2006.01) |
| ***F04C 29/02*** | (2006.01) |
| ***F04C 29/04*** | (2006.01) |
| ***F04C 18/16*** | (2006.01) |

(52) U.S. Cl.
CPC ..... *F04C 29/026* (2013.01); *F04C 2240/52* (2013.01); *F04C 2240/806* (2013.01); *F04C 2270/195* (2013.01); *F04C 2270/205* (2013.01)

(58) Field of Classification Search
CPC ..... F04C 23/008; F25B 31/008; F25B 2600/0261; F25B 41/065; F25B 31/004; F01C 21/002
See application file for complete search history.

(56) References Cited

U.S. PATENT DOCUMENTS

| | | | | |
|---|---|---|---|---|
| 4,780,061 | A | 10/1988 | Butterworth | |
| 4,995,797 | A * | 2/1991 | Tsuboi | F04C 29/0014 418/201.1 |
| 5,028,220 | A | 7/1991 | Holdsworth | |
| 5,082,427 | A * | 1/1992 | Fujiwara | F04C 29/042 417/292 |
| 5,626,470 | A * | 5/1997 | Gerhardt | F04C 29/0021 184/6 |
| 5,832,737 | A * | 11/1998 | Moilanen | F04C 28/125 62/228.5 |
| 6,035,651 | A * | 3/2000 | Carey | F04C 28/06 62/115 |
| 6,205,808 | B1 * | 3/2001 | Beekman | F04C 28/28 418/DIG. 1 |
| 9,097,255 | B2 | 8/2015 | Kobayashi et al. | |
| 2012/0207634 | A1 | 8/2012 | Heger | |
| 2012/0237382 | A1 | 9/2012 | Yoshimura | |

FOREIGN PATENT DOCUMENTS

| | | | |
|---|---|---|---|
| EP | 0030275 | A1 | 6/1981 |
| EP | 0600313 | A1 | 6/1994 |
| EP | 2896834 | A1 | 7/2015 |
| GB | 2115876 | A | 9/1983 |
| JP | 1037886 | A | 2/1998 |
| JP | 2002039069 | A | 2/2002 |
| JP | 2002332980 | A | 11/2002 |
| JP | 2013231396 | A | 11/2013 |
| KR | 20120083631 | A | 7/2012 |
| WO | 0151813 | A1 | 7/2001 |

* cited by examiner

METHOD FOR REGULATING THE LIQUID INJECTION OF A COMPRESSOR OR EXPANDER DEVICE, A LIQUID-INJECTED COMPRESSOR OR EXPANDER DEVICE, AND A LIQUID-INJECTED COMPRESSOR OR EXPANDER ELEMENT

The present invention relates to a method for controlling the liquid injection of a compressor device or expander device.

BACKGROUND OF THE INVENTION

It is known for example that for the cooling of a compressor device, a liquid, such as oil or water for example, is injected into the rotor chamber of the compressor element.

In this way the temperature at the outlet of the compressor element for example can be kept within certain limits, so that the temperature does not become too low so that the formation of condensate in the compressed air is prevented, and whereby the liquid temperature does not become too high so that the quality of the liquid remains optimum.

The injected liquid can also be used for the sealing and lubrication of the compressor element or expander element so that a good operation can be obtained.

It is known that the quantity and temperature of the injected liquid will affect the efficiency of the cooling, the sealing and the lubrication.

Methods are already known for controlling the liquid injection in a compressor device, whereby use is made of a control based on the temperature of the injected liquid, whereby the control consists of getting the temperature of the injected liquid to fall if more cooling is desired, by having the liquid pass through a cooler.

By controlling the temperature, the viscosity of the liquid, and thus the lubricating and sealing properties thereof, can also be adjusted.

A disadvantage of such a method is that the minimum attainable temperature of the injected liquid is limited by the temperature of the coolant that is used in the cooler.

Methods are also known for controlling the liquid injection in a compressor device or expander device, whereby use is made of a control based on the mass flow of the injected liquid, whereby the control consists of injecting more liquid if more cooling or lubrication is desired for example.

By injecting more liquid the temperature will rise less. This enables a higher injection temperature without exceeding the maximum outlet temperature, so that overdimensioning of the cooler is not required in the event of a high coolant temperature.

A disadvantage of such a method is that it will only enable the temperature of the injection liquid to be controlled indirectly.

An additional disadvantage of the known methods is that when a proportion of the injected liquid is used to lubricate the bearings, this liquid will have the same temperature as the liquid that is injected into the rotor chamber for the cooling thereof.

It has turned out in practice that in such compressor devices or expander devices the lifetime of the bearings is detrimentally affected by a lack of a suitable control of the temperature.

SUMMARY OF THE INVENTION

The purpose of the present invention is to provide a solution to a least one of the aforementioned and other disadvantages and/or to optimise the efficiency of the compressor device or expander device.

The object of the present invention is a method for controlling the liquid injection of a compressor element or expander element, whereby the element comprises a housing that comprises a rotor chamber in which at least one rotor is rotatably affixed by means of bearings, whereby liquid is injected into the element, whereby the method comprises the step of providing two independent separated liquid supplies to the element, whereby one liquid supply is injected into the rotor chamber and the other liquid supply is injected at the location of the bearings; and whereby the aforementioned separated liquid supplies are realised by means of a modular channelling piece of an injection module.

'Independent separated liquid supplies' means that the liquid supplies follow a separate path or route, that starts for example from a liquid reservoir and ends in the rotor chamber on the one hand and at the location of the bearings on the other hand.

The Belgian patent application BE2016/5147, which is incorporated in this application by reference, already describes such a method, except for the injection module.

An advantage is that for each liquid supply, the properties of the injected liquid, such as the temperature and/or mass flow for example, can be controlled separately.

In this way an optimum liquid supply can be provided both for the bearings and for the rotor chamber with the rotors.

In this way the compressor element or expander element can operate more optimally and more efficiently than the already known elements.

The controllable injection of the liquid (or lubricant) provides a way of attaining the most optimum situation concerning the sealing function of the liquid and the hydrodynamic losses due to the liquid, and of being able to reach this optimum operating point for each state of the machine and for each possible liquid injection point in the machine.

An additional advantage is that a modular structure using the modular channelling piece enables this intelligent liquid-injection method to be implemented cost-efficiently in a whole range of rotating volumetric machines.

'Modular' here means that the channelling piece has to be mounted or built onto the housing of the machine concerned. It is not excluded here that one channelling piece can be mounted on different machines or that different channelling pieces are suitable for mounting on a machine, whereby the most suitable channelling piece is selected independently of the (expected) operating conditions of the machine. In other words it is an interchangeable component of the machine.

The channelling piece will split up the liquid supply, whereby for the connection of the channelling piece a few additional openings have to be provided in the housing of the compressor element or expander element.

In the most preferred embodiment the method comprises the step of controlling both the temperature of the liquid and the mass flow of the liquid, for both liquid supplies separately.

This means: the temperature and the mass flow are controlled for each liquid supply, whereby the control for the one liquid supply is done independently of the other liquid supply.

This has the advantage that both the temperature and the quantity of liquid are specifically attuned to the needs of the bearings or the rotor chamber, as the control of the one liquid supply is completely independent of the other liquid supply.

Also it is no longer necessary to provide an overdimensioned cooler.

Moreover, the control of both the temperature and the quantity of liquid has the additional advantage that a synergistic effect will occur.

Both the separate optimisation of the temperature and the quantity of injected liquid will have a positive effect on the efficiency of the compressor element or expander element.

But when both are optimised, there will be a functional interaction between the two controls that yields an improvement in the efficiency of the element that is greater than the sum of the efficiency improvements of both individual controls, so that the controls concern a combination and not merely an aggregation or juxtaposition.

This functional interaction is partly attributable to the—aeration phenomena that relate to the quantity of air dissolved in the liquid.

By controlling both the temperature and the mass flow, the quantity of air dissolved in the liquid is at least partially eliminated, which will increase the efficiency.

On the other hand, account has to be taken of the sealing capacity, partly attributable to the viscosity of the injected liquid and partly to the available mass flow of the liquid. For each operating point there is an ideal combination of liquid flow and viscosity, which is a function of the temperature, whereby both parameters reinforce one another.

Preferably the method comprises the step of controlling the flow of the liquid, the temperature of the liquid and/or the liquid air content of the modular channelling piece.

To this end the channelling piece can be provided with the necessary means, so that the channelling piece is not only responsible for splitting up the liquid supplies, but also for the control of the parameters/properties thereof.

These means are preferably integrated in the channelling piece.

The invention also concerns a liquid-injected compressor device or expander device, whereby this compressor device or expander device comprises at least one compressor element or expander element, whereby the element comprises a housing that comprises a rotor chamber in which at least one rotor is rotatably affixed by means of bearings, whereby the compressor device or expander device is further provided with a gas inlet and an outlet for compressed or expanded gas that is connected to a liquid separator, which is connected to the element by means of an injection circuit, whereby the aforementioned injection circuit comprises two at least partially separate injection pipes that open into the rotor chamber and into the housing at the location of the aforementioned bearings respectively, whereby the aforementioned two separate injection pipes are at least partially affixed in a modular channelling piece of an injection module.

Such a compressor installation or expander installation has the advantage that the liquid supplies for the lubrication of the bearings and for the cooling of the rotor chamber can be controlled independently of one another, so that both liquid supplies can be controlled according to the optimum properties that are needed for the bearings and for the rotor chamber respectively at that specific operating point.

The invention also concerns a liquid-injected compressor element or expander element with a housing that comprises a rotor chamber in which at least one rotor is rotatably affixed by means of bearings, whereby the element is further provided with a connection for an injection circuit for the injection of liquid into the element, whereby the connection to the injection circuit is realised by means of a number of injection points in the housing, whereby the housing is further provided with separated integrated channels that start from the aforementioned injection points in the housing and open into the rotor chamber and at the aforementioned bearings respectively, whereby the aforementioned separated integrated channels at least partially form part of a modular channelling piece.

Such a liquid-injected compressor element or expander element can be used in a compressor device or expander device according to the invention. In this way at least a proportion of the injection pipes of the injection circuit of the compressor device or expander device will as it were extend partially separately in the housing of the compressor element or expander element in the form of the aforementioned integrated channels.

Such an approach will ensure that the number of injection points that provide the connection of the injection pipes can be kept limited and that for example the division of the liquid supply to different bearings can be realised by a suitable division of the channels in the housing.

The location of the injection points can also be freely chosen, whereby the channels in the housing will ensure that the oil supply is guided to the appropriate location.

BRIEF DESCRIPTION OF THE DRAWINGS

With the intention of better showing the characteristics of the invention, a few preferred variants of a method for controlling the liquid injection of a compressor device or expander device and a liquid-injected compressor device or expander device according to the invention are described hereinafter by way of an example, without any limiting nature, with reference to the accompanying drawings, wherein.

DETAILED DESCRIPTION OF THE INVENTION

Figure 1:
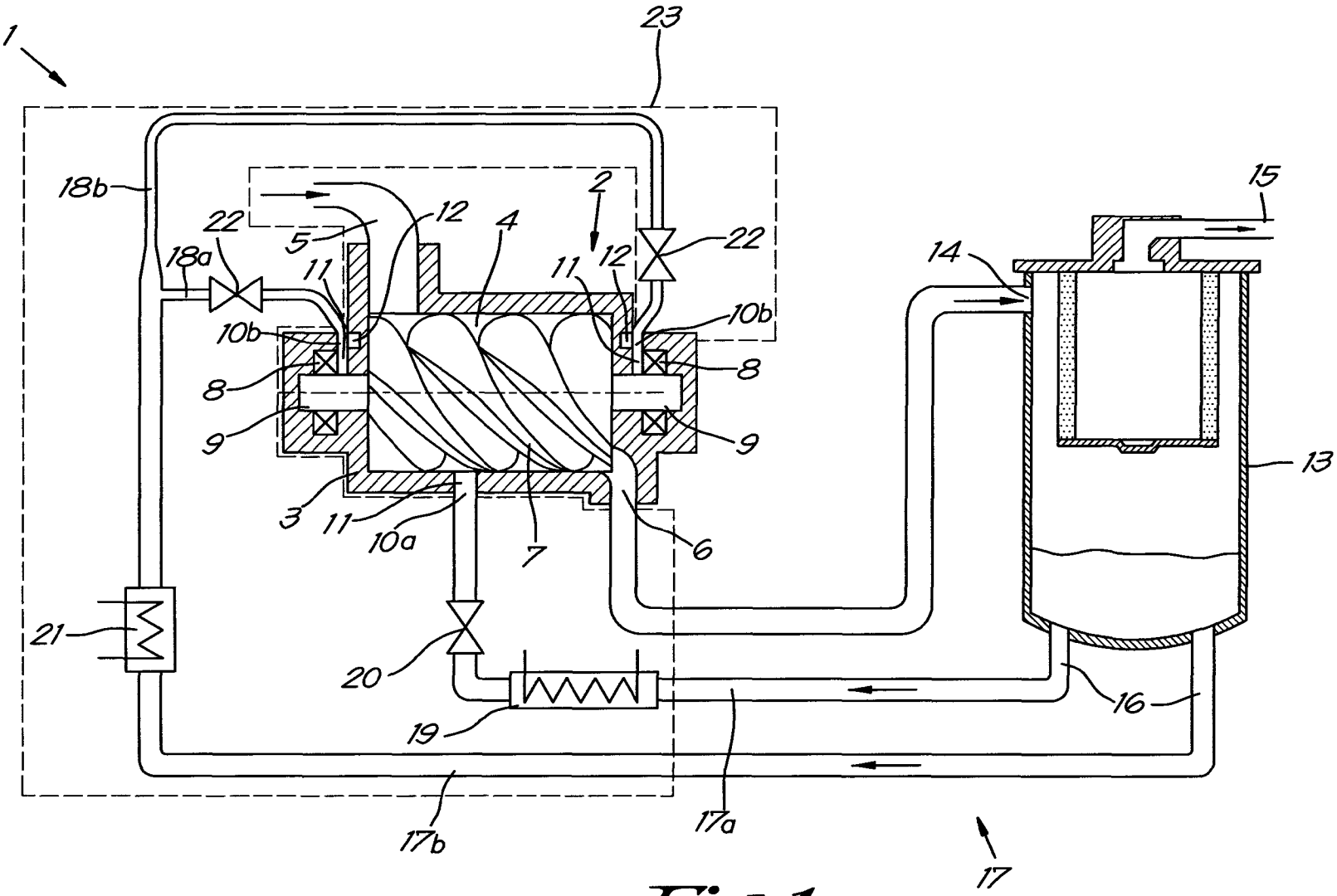
FIG. 1 schematically shows a liquid-injected compressor device according to the invention.

The liquid-injected compressor device 1 shown in FIG. 1 comprises a liquid-injected compressor element 2.

The compressor element 2 comprises a housing 3 that defines a rotor chamber 4 with a gas inlet 5 and an outlet 6 for compressed gas.

One or more rotors 7 are rotatably affixed in the housing 3 by means of bearings 8, in this case in the form of two bearings that are affixed on the shafts 9 of the rotors 7. The bearings 8 can also be realised by means of roller bearings or in the form of a plain bearing.

Furthermore, the housing 3 is provided with a number of injection points 10*a*, 10*b* for the injection of a liquid.

This liquid can for example be synthetic oil or water or otherwise, but the invention is not limited to this as such.

The injection points 10*a*, 10*b* are placed at the location of the rotor chamber 4 and at the location of the aforementioned bearings 8.

According to the invention the housing 3 is provided with separated integrated channels 11 that start from the aforementioned injection points 10*a*, 10*b* in the housing 3 and open into the compression space 4 and the aforementioned bearings 8 respectively.

Additionally one or more cavities 12 can be provided in the housing 3, that can act as a liquid reservoir for liquid for the compression space 4, or as a liquid reservoir for liquid for the bearings 8.

Furthermore, the liquid-injected compressor device 1 comprises a liquid separator 13, whereby the outlet 6 for compressed gas is connected to the inlet 14 of this liquid separator 13.

The liquid separator 13 comprises an outlet 15 for compressed gas, from where the compressed gas can be guided to a consumer network for example, not shown in the drawings.

The liquid separator 13 further comprises an outlet 16 for the separated liquid.

The liquid separator 13 is connected to the aforementioned outlet 16 by means of an injection circuit 17 connected to the compressor element 2.

This injection circuit 17 comprises two separate separated injection pipes 17*a*, 17*b*, which both start from the liquid separator 13.

The injection pipes 17*a*, 17*b* will ensure two separate separated liquid supplies to the compressor element 2.

The injection points 10*a*, 10*b* in the housing 3 ensure the connection of the compressor element 2 to the injection circuit 17.

A first injection pipe 17*a* leads to the aforementioned injection point 10*a* at the location of the compression space 4.

The second injection pipe 17*b* leads to the injection points 10 that are placed at the location of the bearings 8.

In this case, but not necessarily, there are two injection points 10*b* for the bearings 8, i.e. one for each end of the shaft 9 of the rotor 7.

To this end the second injection pipe 17*b* will be split into two sub-pipes 18*a*, 18*b*, whereby one sub-pipe 18*a*, 18*b* will come out at each end of the shaft 9.

A cooler 19 is provided in the first injection pipe 17*a*.

A controllable valve 20 is also provided, in this case, but not necessarily, a throttle valve.

By means of this throttle valve the quantity of liquid that is injected into the compression space 4 can be adjusted.

A cooler 21 is also provided in the second injection pipe 17*b*, and in this case two controllable valves 22 are provided, one in each sub-pipe 18*a*, 18*b*.

The operation of the compressor device 1 is very simple and as follows.

During the operation of the compressor device 1 a gas, for example air, will be drawn in via the gas inlet 5 that will be compressed by the action of the rotors 7 and leave the compressor element 2 via the outlet.

As liquid is injected into the compression space 4 during operation, this compressed air will contain a certain quantity of the liquid.

The compressed air is guided to the liquid separator 13.

There the liquid will be separated and collected underneath in the liquid separator 13.

The compressed air, now free of liquid, will leave the liquid separator 13 via the outlet 15 for compressed gas and can be guided to a compressed gas consumer network, for example, not shown in the drawings.

The separated liquid will be carried back to the compressor element 2 by means of the injection circuit 17.

A proportion of the liquid will be transported to the compression space 4 via the first injection pipe 17*a* and the channels 11 connected thereto, another proportion to the bearings via the second injection pipe 17*b*, the two sub-pipes 18*a*, 18*b* and the channels 11 connected thereto.

Hereby the coolers 19, 21 and the controllable valves 20, 22 will be controlled according to a method that consists of first controlling the mass flow of the liquid supplies, i.e. the controllable valves 20, 22, and then controlling the temperature of the liquid supplies, i.e. the coolers 19, 21.

The aforementioned control is thus a type of master-slave control, whereby the master control, in this case the control of the controllable valves 20, 22 is always done first.

It is important to note here that the coolers 19, 21 and controllable valves 20, 22 are controlled independently of one another, this means that the control of the one cooler 19 is not affected in any way by the control of the other cooler 21 or that the control of the one controllable valve 20 has no effect on the control of the other controllable valves 22.

The control will be such that the properties of the liquid are attuned to the requirements for the compression space 4 and for the bearings 8 respectively.

As already mentioned above, by applying both controls a synergistic effect will occur as a result of a functional interaction between the two controls.

According to the invention the separated liquid supplies are realised by means of a modular channelling piece 23, schematically shown in FIG. 1 by the dashed line.

For example, the aforementioned two separate injection pipes 17*a*, 17*b* are affixed in the modular channelling piece 23 and/or the aforementioned separated integrated channels 11 will form part of the modular channelling piece 23. The controllable valves 20, 22 and if applicable the coolers 19, 21 also form part of the channelling piece 23.

Figure 2:
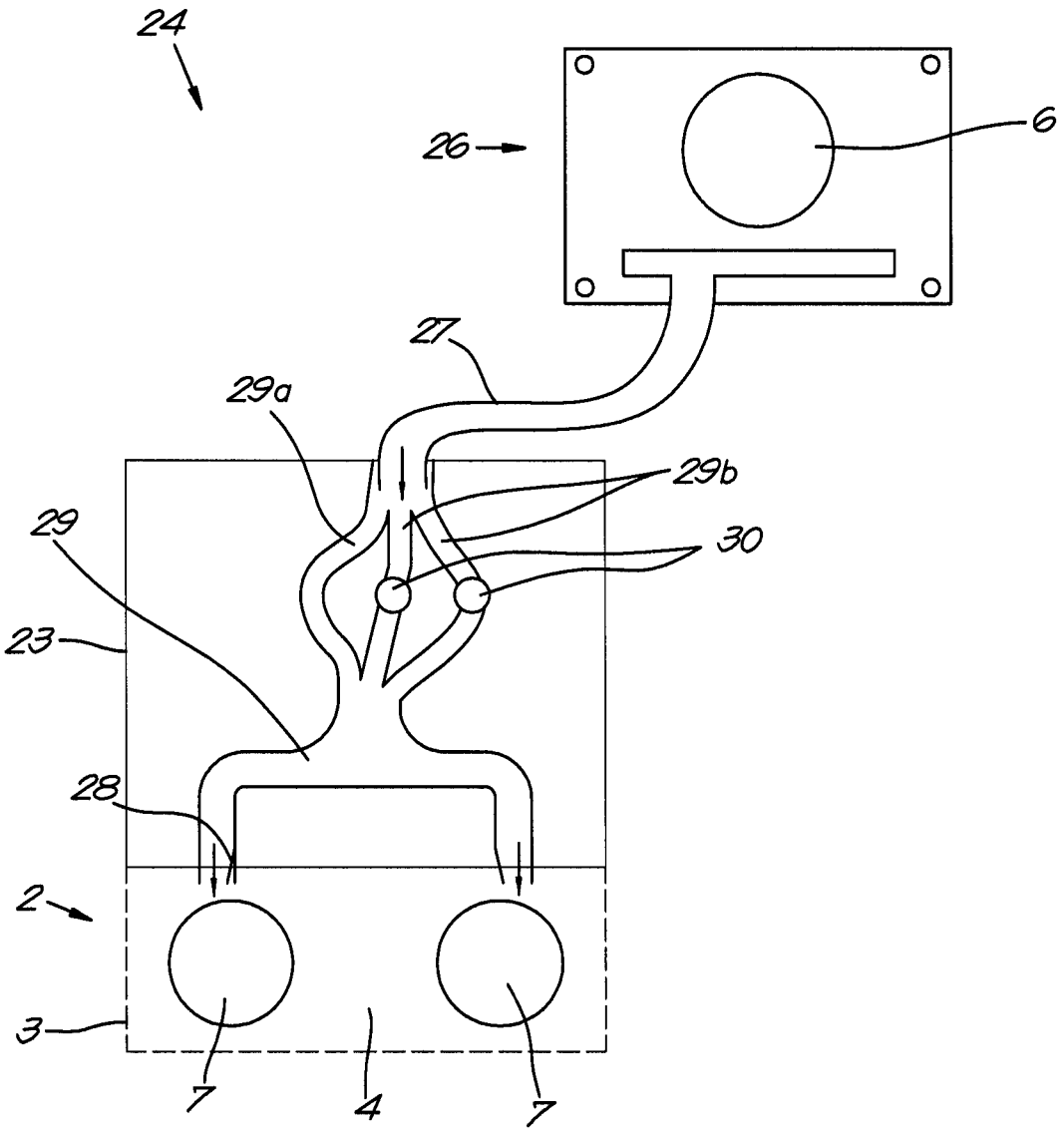
FIG. 2 schematically shows an injection module according to the invention that is provided outside a compressor element.

An embodiment of the injection module 24 with the modular channelling piece 23 is shown in FIG. 2.

The controllable or adjustable control parameters of an injection module 24 according to the invention may include the lubricant flow (which is converted into pressure drops), the temperature of the lubricant and the lubricant air content of the injection module 24.

Manufacturing techniques for making injection modules 24 according to the invention can include conventional processing techniques and/or additive manufacturing techniques. Materials that can be used include metals and polymers for example, but the invention is not limited as such.

According to the invention the injection module 24 is designed as an interchangeable component, with possible integration of flow control to each liquid injection point 10*a*, 10*b* in the compressor element 2. These means for controlling the lubricant flow can comprise, for example, the controllable valves 20, 22 and/or pneumatic, hydraulic as well as electrical actuation means. The pneumatic and/or hydraulic actuation can be realised by means of direct or indirect pressure signals that are already present in the compressor element. Conventional 'packaged check valves', o-stop valves and thermostatic valves can also be integrated in the module.

Possible applications are 'fixed speed' machines over the entire pressure range, and variable speed machines over the entire speed and pressure range.

FIG. 2 shows a possible embodiment of an injection module according to the invention. As can be seen in this drawing the presented injection module 24 comprises three parts for example, i.e. an interface 26, a connecting channel 27 and the modular channelling piece 23, also called manifold or nozzle component in this text. In this drawing the interface 26 with the check valve/O-stop is shown, as well as the outlet 6 of the compressor element 2. This interface 26 is constructed in the form of a flange that is placed at the outlet 6 of the compressor element 2, which ensures a tapping off of liquid to the modular channelling piece 23.

The connecting channels 27 connect to the compressor element 2, and more specifically to the rotor chamber 4 via nozzle components 23 provided to this end, which according to a preferred characteristic of the invention are manufactured by means of additive manufacturing techniques. The connecting channels 27 connect the interface 26 to the modular channelling piece 23.

According to a particular characteristic of the invention the lubricant supply can be provided with constriction means 28 in one or more of the nozzle components 23, in order to thus restrict the supply of lubricant, such as oil, to certain parts of the compressor element 2.

As already mentioned, the injection pipes 17*a*, 17*b* and the channels 11 are integrated in the channelling piece 23. The channels 29 of the channelling piece 23 can be provided with one or more sub-channels 29*a*, 29*b* that can be provided with actuation means in the form of solenoid valves 30 in order to enable a control of the liquid supply.

The channelling piece 23 is preferably manufactured by means of additive manufacturing techniques. The other two components, i.e. the interface 26 and the connecting channels 27, can be manufactured with conventional manufacturing techniques and materials, or can be incorporated in the piece that is manufactured by means of additive manufacturing techniques.

The manifold 23 comprises a bypass channel 29*a* and two channels 29 that can be closed by means of solenoid valves 30. By correctly dimensioning these channels 29*a*, 29*b* and valves 30 four discrete flow rates can be obtained, whereby each flow rate is optimised for a certain range of conditions of a certain application. Adjustments to the compressor element 2 to which the modular channelling piece is connected are small compared to conventional compressor elements 2: only one additional opening has to be provided per rotor in the housing 3 of the compressor element 2. Depending on the location of this opening, the conventional oil channels present in the housing 3, along which oil or lubricant is supplied to the gear wheels and the bearings, can be optimally throttled in a controlled way by means of constriction means 28 in the form of nozzle inserts for example.

Such a manifold 23 can be manufactured for example by means of SLS (selective laser sintering) additive manufacturing of polyamide. Making the lubricant flow controllable is a possible option.

Figure 3:
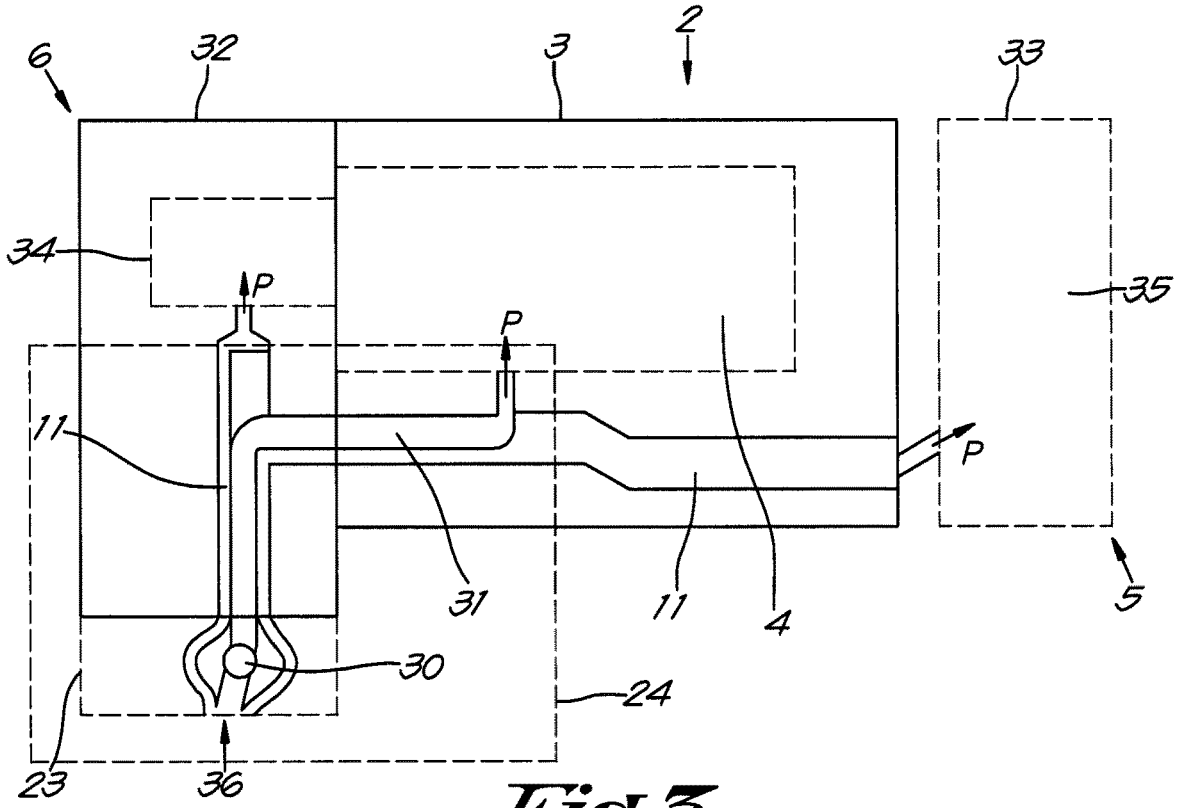
FIG. 3 shows another embodiment of an injection module according to the invention.

FIG. 3 schematically shows an injection module 24 according to the invention, suitable for both fixed speed and VSD (variable speed) applications. The parts or components 31 of the injection module 24 that are present in the machined channels 11 distribute the oil flow to different parts of the compressor element 2. The manifold 23 outside the compressor element 2 connects these separated channels 11 to solenoid valves 30 (a group of solenoid valves 30 similar to the embodiment of FIG. 2 with external injection module 24).

FIG. 3 shows the bearing housing 32 on the outlet side 6 of the rotor housing 3, as well as a gearbox 33, bearings 34 on the outlet side 6, and bearings and if applicable a gearbox 35 on the inlet side 5 of the compressor element 2. There is a rotor chamber 4 in the compressor element 2.

The side along which the oil enters is shown by reference number 36. The various arrows P indicate the flow direction of the lubricant in the various channels 11. Furthermore the channelling piece 23 and a solenoid 30 can be seen.

In this embodiment a number of the components 31 of the injection module 24 are affixed in the existing lubrication channels 11 of a compressor element.

To this end, if necessary these existing channels 11 can be widened and/or extended. For applications with a constant speed and at constant ambient conditions, the design of the flow restrictions of the integrated injection module 24 according to the optimum lubricant flow rate will lead to an injection module 24 according to the invention. This means that different applications will be able to make use of the same compressor elements 2, but also different optimised modular channelling pieces 23.

For applications with a variable speed (i.e. with a VSD driving the compressor element 2) and also at variable ambient conditions, an embedded electrical control of the optimum flow is difficult on account of the need to construct the components 31 of the injection module 24 as compactly as possible. In such a case, use can be made of embedded pneumatic and/or hydraulic valves, for example, driven by direct or indirect pressure signals (an example of an indirect pressure signal is the dynamic pressure of a high-speed flow), or use can be made of similar pneumatic and/or hydraulic valves or electrically controlled valves that form part of an additional external component that is fastened on the outside of the compressor element 2.

It goes without saying that the separation of the channels can be realised by means of conventional processing techniques of the compressor element 2 if any cast components so allow (or with additional modifications of any cast parts). The external injection module 24 (that is connected to the valves and the collected oil or lubricant) can also be implemented in the conventional manner.

Grooved cutaways 37 can be provided at the places in the manifold 23 where the solenoid valves 30 have to be provided. These solenoids 30 can then be mounted in the appropriate place by sliding them in the grooved cutaways 37 concerned and then fixing them if need be, for example by means of a fixation gib 38. In this way, the use of glue or screws and bolts is avoided such that a robust connection can be ensured, even at high temperatures and in the event of mechanical vibrations of the machine.

Figure 4:
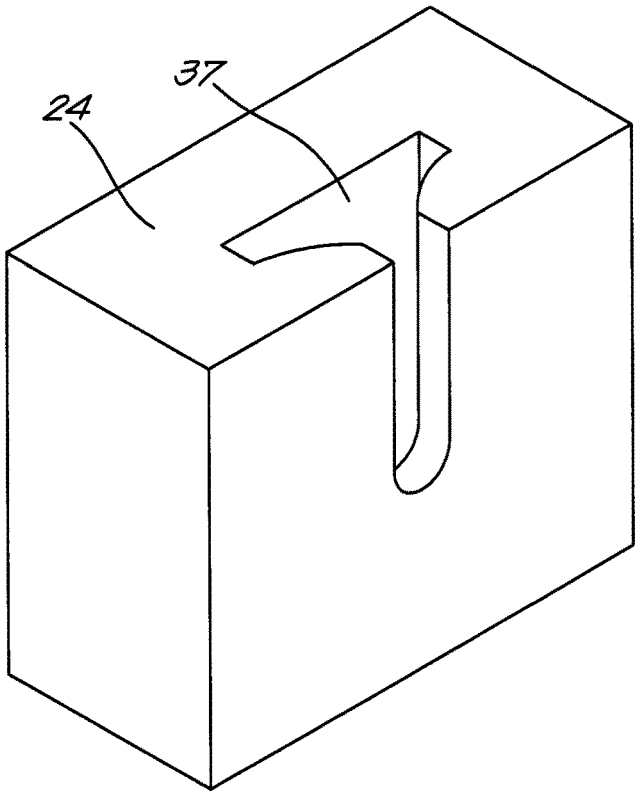
FIG. 4 shows facilities for mounting a solenoid.

FIG. 4 shows an example of such a grooved cutaway 37. The cutaway 37 can gradually narrow in the direction of the seat of the solenoid 30, in order to press this solenoid 30 against the wall of the cutaway 37 on the flow side.

Figure 5:
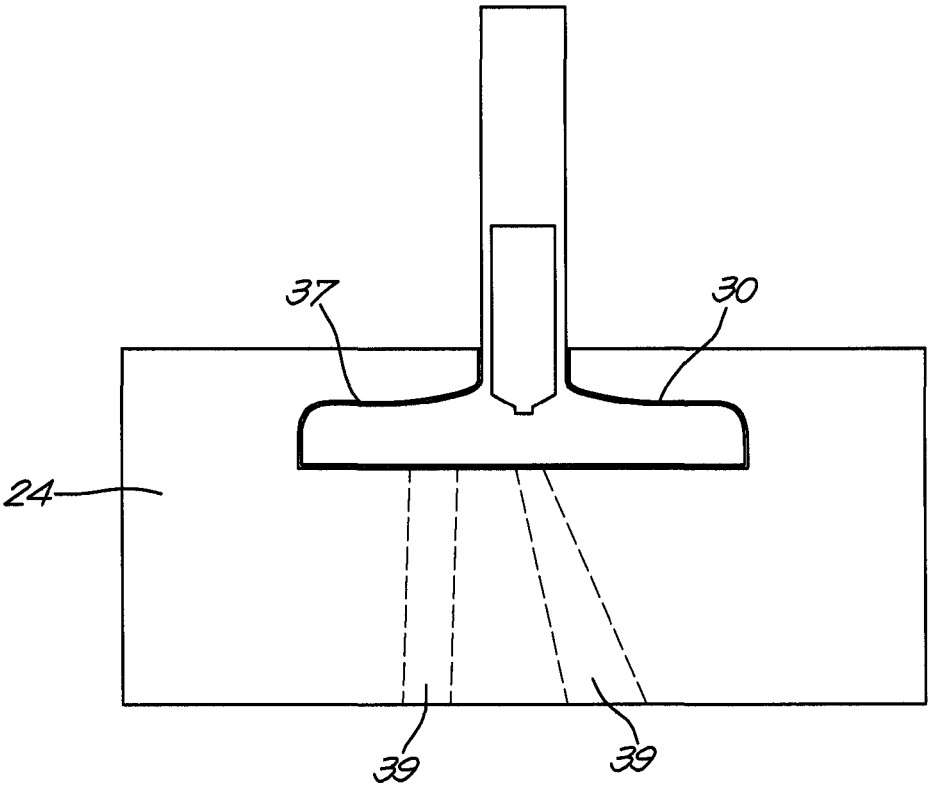
FIG. 5 shows a top view of a solenoid in the mounted situation in a cutaway according to FIG. 4.

FIG. 5 shows a top view of a solenoid 30 in the mounted situation in a cutaway 37 (the coils are not shown). The dashed lines represent oil channels 39 to and from the solenoid manifold 23.

Figure 6:
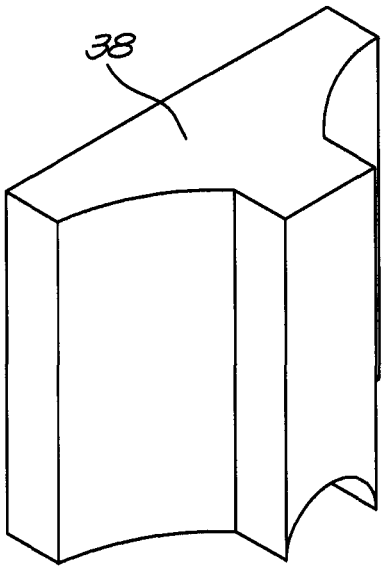
FIG. 6 shows securing means of the solenoid in an unmounted situation.
Figure 7:
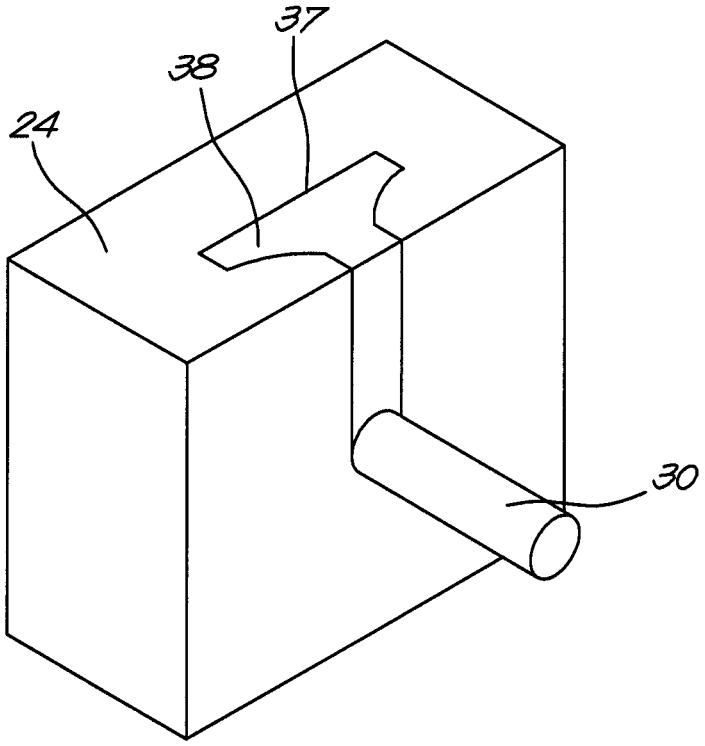
FIG. 7 shows the securing means of FIG. 6 in a mounted situation.

FIG. 6 shows a gib 38 and FIG. 7 shows how such a gib 38 can be mounted as securing means. The back of this gib 38 can have a complex shape that corresponds to the shape of the solenoid 30.

Preferably the method consists of controlling the temperature and mass flow of the liquid supplies such that the specific energy requirement (SER) of the liquid-injected compressor device 1 is a minimum.

The specific energy requirement is the ratio of the power (P) of the compressor device 1 to the flow rate (FAD) supplied by the compressor device 1 converted back to the inlet conditions of the compressor element 2.

According to the invention the aforementioned liquid can be oil or water for example.

The examples shown above describe a compressor device and compressor element according to the invention. It is clear that the situation for an expander device and an expander element is very similar, whereby essentially only the direction of the flow changes, so that the inlet becomes the outlet and vice versa. In addition, the compressor element and the compressor device can relate to a vacuum pump.

The present invention is by no means limited to the embodiments described as an example and shown in the drawings, but such a method for controlling the liquid injection of a compressor device and a liquid-injected compressor device according to the invention can be realised according to different variants without departing from the scope of the invention.

The invention claimed is:

1. A method for controlling liquid injection of a compressor device or expander device, wherein the compressor device or expander device comprises at least one compressor element or at least one expander element, wherein the at least one compressor element or the at least one expander element comprises a housing that comprises a rotor chamber in which at least one rotor is rotatably affixed by means of bearings, wherein the method comprises steps of:

providing two independent separated liquid supplies to the at least one compressor element or the at least one expander element to inject at least a first liquid supply and at least a second liquid supply into the at least one compressor element or the at least one expander element, wherein the at least first liquid supply is injected into the rotor chamber and the at least one second liquid supply is injected at location of the bearings; and wherein the two independent separated liquid supplies are realised by means of a modular channelling piece of an injection module and the two independent separated liquid supplies are supplied separately and independently from a liquid separator, further comprising a step of separately controlling a temperature and a mass flow of the at least one first liquid supply using a first cooler and a first controllable valve and a temperature and a mass flow of the at least one second liquid supply using a second cooler and at least a second controllable valve.

2. The method according to claim 1, further comprising a step of controlling liquid air content of the modular channelling piece.

3. The method according to claim 2, wherein for the step of controlling of the mass flow of the first or second liquid supplies, use is made of pneumatic, hydraulic and/or electrical actuation means.

4. The method according to claim 3, wherein for the pneumatic or hydraulic actuation, use is made of direct or indirect pressure signals that are present in the compressor element or expander element.

5. The method according to claim 3, wherein the actuation means comprise one or more solenoid valves that are affixed in the modular channelling piece.

6. The method according to claim 1, wherein the method consists of controlling the temperature and the mass flow of the at least first and the second liquid supplies such that a specific energy requirement is a minimum, whereby the specific energy requirement is a ratio of the power of the compressor device or expander device to the flow rate supplied by the at least one compressor device or the at least one expander device converted back to an inlet conditions of the at least one compressor element or the at least one expander element.

7. A liquid-injected compressor device or expander device comprising:

at least one compressor element or expander element, wherein the at least one compressor element or the at least one expander element comprises a housing that comprises a rotor chamber in which at least one rotor is rotatably affixed by means of bearings, wherein the at least one compressor device or the at least one expander device is further provided with a gas inlet and an outlet for compressed or expanded gas that is connected to a liquid separator, said liquid separator being connected to the at least one compressor element or the at least one expander element by means of an injection circuit, wherein the injection circuit comprises at least two separate injection pipes that open into the rotor chamber and into the housing at a location of the bearings respectively; and wherein the two separate injection pipes are at least partially affixed in a modular channelling piece of an injection module and the at least two separate injection pipes are connected separately and independently to the liquid separator, wherein a first cooler and first controllable valve is provided in a first injection pipe of the at least two separate injection pipes to control temperature and mass flow of a first liquid supply supplied to the rotor chamber and a second cooler and at least a second controllable valve is provide in a second injection pipe of the at least two separate injection pipes to control temperature and a mass flow of a second liquid supply supplied to the bearings in the housing.

8. The liquid-injected compressor device or expander device according to claim 7, wherein at least one of the controllable valves comprise a throttle valve or a solenoid valve.

9. The liquid-injected compressor device or expander device according to claim 7, wherein the injection module is further provided with an interface in form of a flange that is placed at the outlet of the at least one compressor element or the at least one expander element that ensures the tapping off of liquid to the modular channelling piece.

10. The liquid-injected compressor device or expander device according to claim 9, wherein the injection module is further provided with a connecting channel between the interface and the modular channelling piece.

11. The liquid-injected compressor device or expander device according to claim 7, wherein the at least two separate injection pipes of the modular channelling piece, comprise a bypass channel and one or more closable channels.

12. A liquid-injected compressor element or expander element with a housing that comprises a rotor chamber in which at least one rotor is rotatably affixed by means of bearings, wherein the compressor element or the expander element is further provided with a connection for an injection circuit for the injection of liquid into the compressor element or the expander element, wherein the connection to the injection circuit is realised by a number of injection points in the housing, wherein the housing is further provided with separated integrated channels that start from the injection points in the housing and open into the rotor chamber and at the bearings respectively; and wherein the separated integrated channels at least partially form part of a modular channelling piece of an injection module and are adaptable to control flow rates for a certain range of conditions of the compressor element or the expander element, wherein a first integrated channel of the separated integrated channels is provided with a first cooler and a first controllable valve to control temperature and a mass flow of a first flow rate to the rotor chamber and a second integrated channel of the separated integrated channels is provided with a second cooler and a second controllable valve to control temperature and a mass flow of a second flow rate to the bearings, and wherein the first flow rate to the first integrated channel and the second flow rate to the second integrated channel of the separated integrated channels are supplied separately and independently from a liquid separator.

13. The liquid-injected compressor element or expander element according to claim 12, wherein a separate injection point is provided for each of the separated integrated channel or that more than one of the separated integrated channel starts from at least one injection point.

14. The liquid-injected compressor element or expander element according to claim 12, wherein a separate channel of the separated integrated channel is provided for each bearing and/or that more than one of the separated integrated channel is provided for the rotor chamber.

15. The liquid-injected compressor element or expander element according to claim 12, wherein one or more cavities are provided in the housing or in the modular channelling piece that act as a liquid reservoir for liquid for the rotor chamber or for the bearings, whereby these cavities provide a connection between the injection points and one or more of the separated integrated channels connected thereto.

16. The liquid-injected compressor element or expander element according to claim 12, wherein at least one of the controllable valves comprise a throttle valve or a solenoid valve.

17. The liquid-injected compressor device or expander device according to claim 12, wherein the injection module is further provided with an interface in the form of a flange that is placed at the outlet of the element that ensures a tapping off of liquid to the modular channelling piece.

18. The liquid-injected compressor device or expander device according to claim 17, wherein the injection module is further provided with a connecting channel between the interface and the modular channelling piece.

19. The liquid-injected compressor device or expander device according to claim 12, wherein the separated integrated channels of the modular channelling piece comprise one bypass channel and one or more closable channels.

20. The liquid-injected compressor device or expander device according to claim 12, wherein the injection module is provided with components that are affixed in the channels, whereby these components distribute the liquid flow in the channels concerned.

* * * * *